US005823425A

United States Patent [19]

Jones

[11] Patent Number: 5,823,425

[45] Date of Patent: Oct. 20, 1998

[54] RUBBER TIRE MAILBOX

[76] Inventor: Russell Albert Jones, 3987 Buck Island Rd., Charlottesville, Va. 22902

[21] Appl. No.: 794,924

[22] Filed: Feb. 4, 1997

Related U.S. Application Data

[63] Continuation of Ser. No. 549,511, Jan. 30, 1996, abandoned.

[51] Int. Cl.[6] ..... B65D 91/00

[52] U.S. Cl. ..... 232/17

[58] Field of Search ..... 232/17, 38, 39

[56] References Cited

U.S. PATENT DOCUMENTS

| | | | |
|---|---|---|---|
| 4,244,512 | 1/1981 | Wise | 232/17 |
| 4,367,844 | 1/1983 | Drummond | 232/17 |
| 5,435,483 | 7/1995 | Cox | 232/38 |

*Primary Examiner*—Jerry Redman

[57] ABSTRACT

A mailbox whose construction is chiefly made up of a used rubber motor vehicle tire provides self protection from impact damage by utilizing the rubber tire's shock absorption qualities and also provides an environmentally responsible use for post consumer vehicle tires; thereby possibly reducing the number of tires sent to landfills.

5 Claims, 2 Drawing Sheets

101
102
104
105
106
108
109
111
112
114
115

20 deg.
both ends
113
106
105
104
112
109
111
90 deg.
102
103
107
114
101
108
15 deg
110

RUBBER TIRE MAILBOX

This is a continuation of Ser. No. 08/549,511 filed Jan. 30, 1996, now abandoned.

REFERENCES CITED

| U.S. PATENT DOCUMEMTS | | | |
|---|---|---|---|
| 4,187,978 | 1/1983 | Delange | 232/17 |
| 5,035,356 | 7/1991 | Granger | 232/17 |
| 5,460,326 | 10/1995 | Albanesius | 232/39 |
| Des. 335,755 | 5/1993 | Davis et al. | D99/32 |
| 4,901,913 | 2/1990 | Fischer | 232/17 |

BACKGROUND OF THE INVENTION

1. Field of the Invention

Relates to rural or curbside mailboxes whose protection from damage by the impact of snowplow debris or drive by vandalism is inherent to its construction.

2. Brief Description of the Prior Art

There is no known patent art relating specifically to rubber tire mailboxes. Rather than an add-on device to an existing mailbox as a protection from damage, the invention's construction is inherently a self protecting unit. Roadside mailboxes often are damaged by snow plow debris (e.g. heavy snow, rocks and sticks) thrown by the blade when working close to the side of the road. Also, vandals swinging clubs, baseball bats or throwing rocks denting or crushing the thin guage metal (e.g. 22 guage) used in the mailbox construction or in some instrances even knocking the mailbox off their post is becoming more common all the time.

Also, in reference to the invention's body or top enclosure material being constructed from a cut out section of a rubber vehicle tire, finding a use for used vehicle tires instead of piling them in landfills is an environmentally responsible solution.

BRIEF SUMMARY OF THE INVENTION

It is an object of the invention to provide a mailbox whose construction creates self protection from impact damage.

A further object or preferred embodiment of the invention provides a use for discarded rubber tires which would previously been sent to a landfill this making it an environmentally responsible use of a post consumer resource.

It is a further object or preferred embodiment of the invention that it have a base or bottom or body consisting of a channel iron or formed metal or fiberglass or material of comparable strength having a back wall and front hinged door of similar material and strengh and descending brackets with aperatures for fastening to a support structure.

It is a further object that the mailbox design being unique also provides for numeric labeling of a size to meet specifications set our by the emergency 911 services for identification of rural addresses on mailboxes (e.g. numbering being a minimum of 3" in height) as to be visible by emergency vehicles on the road.

These and other objects and advantages of the invention will be shown in the following descriptions made in connection with the accompanying drawings in which the same reference characteristics refer to similar parts throughout the various views.

DETAILED DESCRIPTION OF THE INVENTION

Figures 1, 2:
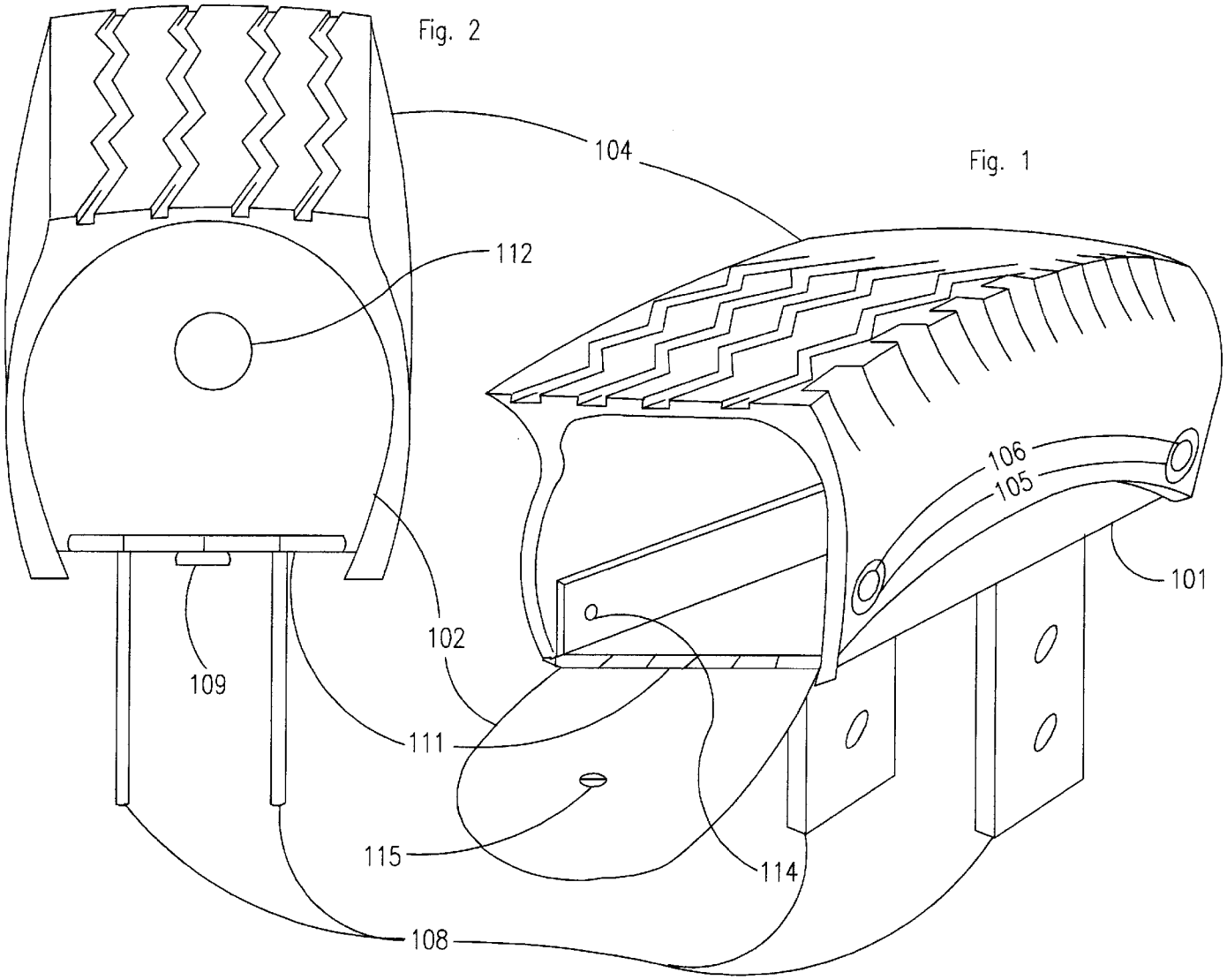
FIG. 1 is a perspective view of a rubber tire mailbox.
FIG. 2 is a front elevational view.

Referring to the drawings, the structure that makes up the invention herein is described by reference numbers. Each of the reference numbers refers to all views, FIGS. 1, 2 & 3, unless noted within the following description. The base (101), or floor of the mailbox is made of channel iron, or durable plastic or formed metal or fibergalss or material of comparable strength with a plate door (102), and a welded or formed plate back (103) FIG. 3 of similar material and strength both shaped to fit inside or against the contour of the inner surface of the tire section used to make the cap (104). The door (102) is attached by means of any type of compatible hinge (111) that will allow the door to be opened and closed. Two extension pieces welded or formed or attached to the bottom of the base (101) to be used as mounting brackets (108) with holes clearance drilled to allow the threaded rod (107) FIG. 3 to pass through. The cap (104) is made of a section cut from a used motor vehicle tire and the hinged (111) door (102) while it is open, is held horizontal by a tab or other type door rest (109), FIG. 2 & 3, or the hinge (111) may incorporate a stop to keep the open door (102) horizontal. The knob (112) FIG. 2 & 3, or handle, used to pull open the door (102) can be plastic or metal or ceramic and held fastened to the door (102) by means of a screw (115) FIG. 1 long enough to be passed through the back of the door (102) and threaded into the knob or handle (112). For use as a red mail flag, a length of red weatherproof ribbon attached to the back of the door (102) by a screw (115) FIG. 1 can be hung to the outside as a signal when needed.

Figure 3:
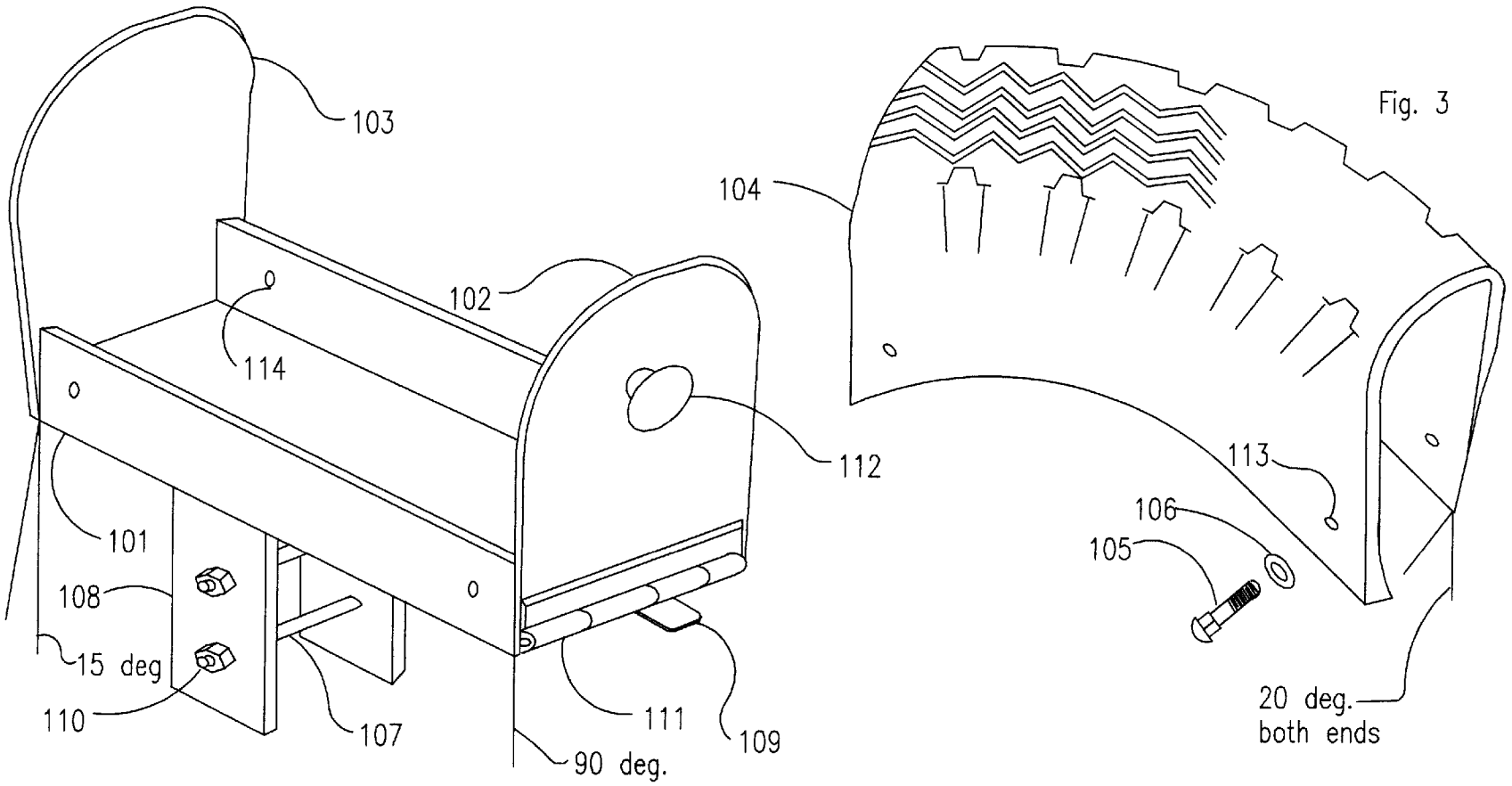
FIG. 3 is an exploded view in perspective.

The cap (104) was cut from a truck tire, but this style of mailbox could be made to use a section of most any size vehicle tire depending upon the desired capacity. Ecologically, this is a plus because it provides a use for used rubber tires. The use of carriage bolts (105) FIG. 1 & 3, of a rust or corrosion resistant material passing through flat washers (106) FIG. 1 & 3 which can be of the same resistant material and then passing through punched or cut holes (113) FIG. 3 in the tire cap (104) large enough for the shaft of the bolts (105) FIG. 1 & 3 to pass through, but smaller in diameter than the washer (106) FIG. 1 & 3 so as to be held in place against the tire cap (104) when the bolt (105) FIG. 1 and 3 is tightened on into the threaded holes (114) FIG. 1 & 3 in the base (101) that are sized and threaded to accept the bolts to fasten the cap (104) to the base (101); and then the peening over or flattening of the ends of the threaded rod (107) FIG. 3 used to secure the mailbox to the post after the hex nuts (110) FIG. 3 have been tightened (these nuts can also be composed of a corrosion or rust resistant material), reduces the risk of unauthorized disassembly.

It will be understood that changes may be made in form, detail, and arrangement of proportions of the item without changing the intent of the invention, which, as stated consists of a mailbox with the properties and qualities described above and in the following claims.

What is claimed is:

1. A mailbox comprising a base portion, side extensions extending opposite from one another and perpendicular from a top portion of the base portion with a back wall attached to one end of the base portion between the side extensions and extending from the top portion of the base portion above the side extensions, a hinged door attached to the base portion opposite from the back wall, a pair of vertical extensions extending from a bottom portion of the base portion, and a rubber tire portion having an arcuate inner surface and an outer surface having two substantially vertical side walls with the vertical side walls of the rubber tire portion being attached to the side extensions of the base portion thereby forming a closed receptacle.

2. The mailbox of claim 1 further comprising a top portion of the outer surface of the rubber tire portion having treads.

3. The mailbox of the claim 1 further comprising holes within the side extensions and holes within the vertical side walls of the rubber tire portion and fasteners extending within the holes of the side extensions and holes of the vertical side walls of the rubber tire portion.

4. The mailbox of claim 1 further comprising the base portion, the side extensions, the back wall, the hinged door, and the pair of vertical extensions are formed of metal.

5. The mailbox of claim 1 further comprising the base portion, the side extensions, the back wall, the hinged door, and the pair of vertical extensions are formed of fiberglass.

* * * * *